US005446933A

United States Patent [19]

Gabelhouse

[11] Patent Number: 5,446,933

[45] Date of Patent: Sep. 5, 1995

[54] BED WITH A PLURALITY OF VERTICALLY ALIGNED BODY SUPPORT MEMBERS WHICH COMMUNICATE WITH A COMMON FLUID CHAMBER

[76] Inventor: Robert D. J. Gabelhouse, 18844-81A Avenue, Edmonton, Alberta, Canada, T5T 5A7

[21] Appl. No.: 87,334

[22] Filed: Jul. 8, 1993

[30] Foreign Application Priority Data

Jul. 8, 1992 [CA] Canada ..... 2073424

[51] Int. Cl.[6] ..... A47C 27/08; A61G 7/057

[52] U.S. Cl. ..... 5/448; 5/451; 5/933

[58] Field of Search ..... 5/451, 450, 448, 449, 5/453, 933

[56] References Cited

U.S. PATENT DOCUMENTS

| | | | |
|---|---|---|---|
| 1,212,479 | 1/1917 | Hall | 5/451 |
| 3,656,190 | 4/1972 | Regan et al. | 5/933 |
| 3,999,234 | 12/1976 | Regan | 5/933 |
| 3,999,235 | 12/1976 | Mollura | 5/451 |
| 4,134,168 | 1/1979 | Guigan | 5/451 |
| 4,617,690 | 10/1986 | Grebe | 5/453 |
| 4,799,276 | 1/1989 | Kadish | 5/933 |
| 4,977,629 | 12/1990 | Jones | 5/61 |
| 4,986,738 | 1/1991 | Kawasaki et al. | 417/304 |
| 5,020,176 | 6/1991 | Dotson | 5/453 |
| 5,060,326 | 10/1991 | Oswald | 5/236.1 |
| 5,090,077 | 2/1992 | Caden et al. | 5/456 |
| 5,210,889 | 5/1993 | Wesemann et al. | 5/236 |

*Primary Examiner*—Alexander Grosz

[57] ABSTRACT

A bed is described which includes a plurality of body support members telescopically received in and protruding vertically from closely spaced vertically aligned body support guides. A fluid chamber underlies the guides. A downward pressure applied to one body support member is transmitted via fluid in the fluid chamber to all body support members. The body support members are telescopically movable relative to the guides in response to fluid pressure. A pressure counterbalance is provided which exerts pressure upon fluid in the fluid chamber to counter pressure exerted upon fluid in the fluid chamber by a body at rest upon the body support members.

8 Claims, 8 Drawing Sheets

BED WITH A PLURALITY OF VERTICALLY ALIGNED BODY SUPPORT MEMBERS WHICH COMMUNICATE WITH A COMMON FLUID CHAMBER

The present invention relates to a bed with a plurality of vertically aligned body support members which communicate with a common fluid chamber.

BACKGROUND OF THE INVENTION

It is common with conventional beds to have a number of semi-connected springs within a mattress. These systems tend to have two inefficiencies. Firstly, the springs are connected and are, therefore, not totally independent of each other. When a downward pressure is exerted upon one spring it exerts a downward pressure upon the adjoining springs to which it is connected. Secondly, each spring has the same load rating which inhibits effective response to all the various weights and contours of a human body.

Waterbeds attempt to solve these problems but introduce two other inefficiencies. Firstly, a "ballooning" of nonused areas of the bed occurs which creates a crater effect where the bulk of body weight is supported. This results in raised legs, head and arms. Secondly, when the membrane to contain the water is made with sufficient strength to avoid bursting or being pierced, it will not flex appropriately to mold itself to body contours.

Attempts have been made to construct beds with a plurality of vertically aligned body support members which communicate with a common fluid chamber. An example of such a bed is U.S. Pat. No. 5,210,889 which issued to Wesemann et al in 1993. This type of bed addresses a number of the described problems. A downward pressure upon one of the body support members does not effect adjoining body support members, and yet such downward pressure is transmitted via fluid in the fluid chamber equally amongst all body support members. The operation of the body support members and common fluid chamber accommodates a differential response to the various weights and contours of the human body. However, beds constructed in accordance with the teachings of Wesemann are still subject to a form of "ballooning" in which a lifting of the unloaded body support members occurs.

SUMMARY OF THE INVENTION

What is required is a bed with a plurality of vertically aligned body support members which communicate with a common fluid chamber in which the problem of ballooning is addressed.

According to the present invention there is provided a bed including a plurality of body support members. A plurality of closely spaced vertically aligned body support guides are provided. One of the body support members is telescopically received in each of the guides with the body support members protruding vertically from the guides. A fluid chamber underlies the guides. A downward pressure applied to one body support member is transmitted via fluid in the fluid chamber to all body support members. The body support members are telescopically movable relative to the body support chambers in response to fluid pressure. Sealing means are provided to prevent leakage of fluid from the fluid chamber. Stop means is provided to limit the telescopic movement of the body support members. A displaceable counterbalance is provided whereby an adjustable preset pressure is exerted upon fluid in the fluid chamber to counter pressure exerted upon fluid in the fluid chamber by a body at rest upon the body support members.

I have found that the disadvantage of ballooning may be overcome by providing the common fluid chamber with a displacement tank that contains a manual or self adjusting counterbalance. The counterbalance exerts an equal and opposite pressure back through the common fluid chamber to each individual body support member. Since all body support members are connected by the common fluid chamber the pressure on each square inch of the body which touches the bed will be almost instantaneously equalized. Automatic equilibrium is achieved for the ultimate in comfort. No points on the body will have any more or less pressure than any other contact area of the body. It is preferred that a plurality of smaller soft tip body supports be used. These can be long thin dowels caped at one end. These dowels move only vertically but independently within their own guides. They are interconnected by the common fluid chamber filled with a gas or a liquid. If the common fluid chamber is in the form of a deformable bladder it simplifies the sealing of the fluid chamber.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

A bed with a plurality of vertically aligned body support members which communicate with a common fluid chamber will now be described. A first embodiment of the bed will be described with reference to FIGS. 1 through 5. A second embodiment of the bed will be described with reference to FIGS. 6 through 10.

Figure 1:
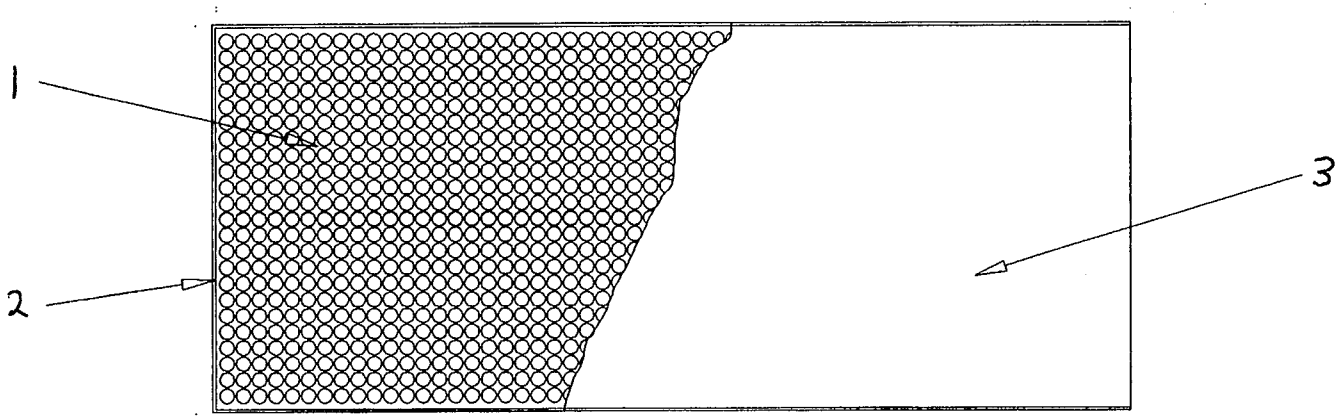
FIG. 1 is a top plan view of a first embodiment of a bed constructed in accordance with the teachings of the present invention.

FIG. 1 illustrates how the bed is comprised of a plurality of body support members in the form of light weight dowels 1 which are inserted into a multi-chambered base 2. There is one body support guide for each dowel, each with perfect circumference to fit the dowel to allow vertical movement only.

Figure 2:
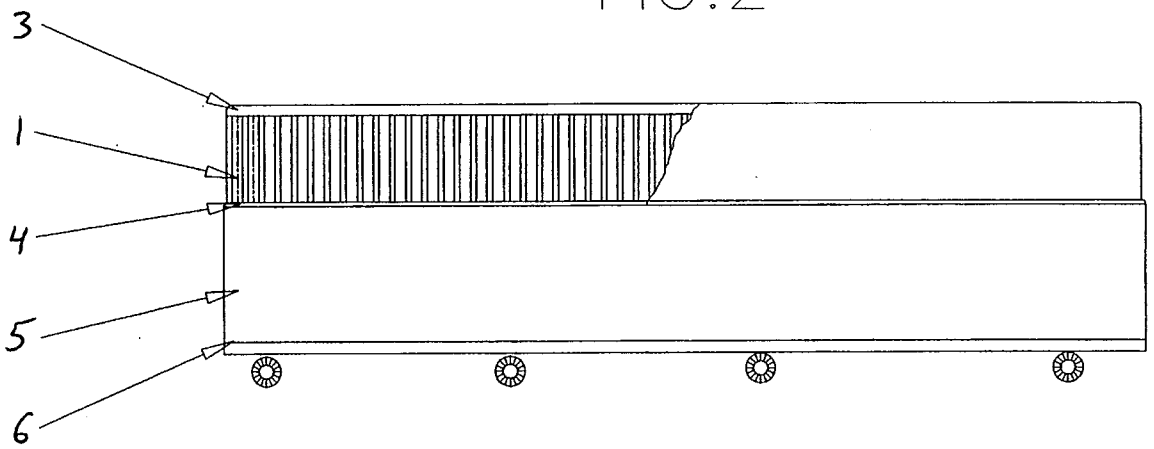
FIG. 2 is a side elevation view in longitudinal section of the bed illustrated in FIG. 1.

FIG. 2 illustrates five basic layers to the bed: a comforter 3, the dowels 1, a gasket seal 4, body support chambers 5, and a common fluid chamber 6. Comforter 3 is a thin foam cushion placed on top of dowels 1 to give a softer touch to the skin. Dowels can be ½" diameter and 14" in length, with rounded tops and enlarged bottoms. The enlarged bottoms serve as stop means to prevent dowels 1 from telescopically leaving their respective chambers 5. Each dowel 1 has independent vertical movement. Each dowel 1 and chamber 5 is equipped with suitable gasket seals 4 to prevent any gas or liquid leakage. Chambers 5 contain the lower portion of each dowel 1. Each chamber 5 is filled with gas or liquid up to the bottom of each dowel. All of chambers 5 are connected to a lower underlying common fluid chamber 6 which is also filled with gas or liquid. Common fluid chamber 6 allows interdependent movement of the gas or liquid between any and all chambers 5.

Figure 3:
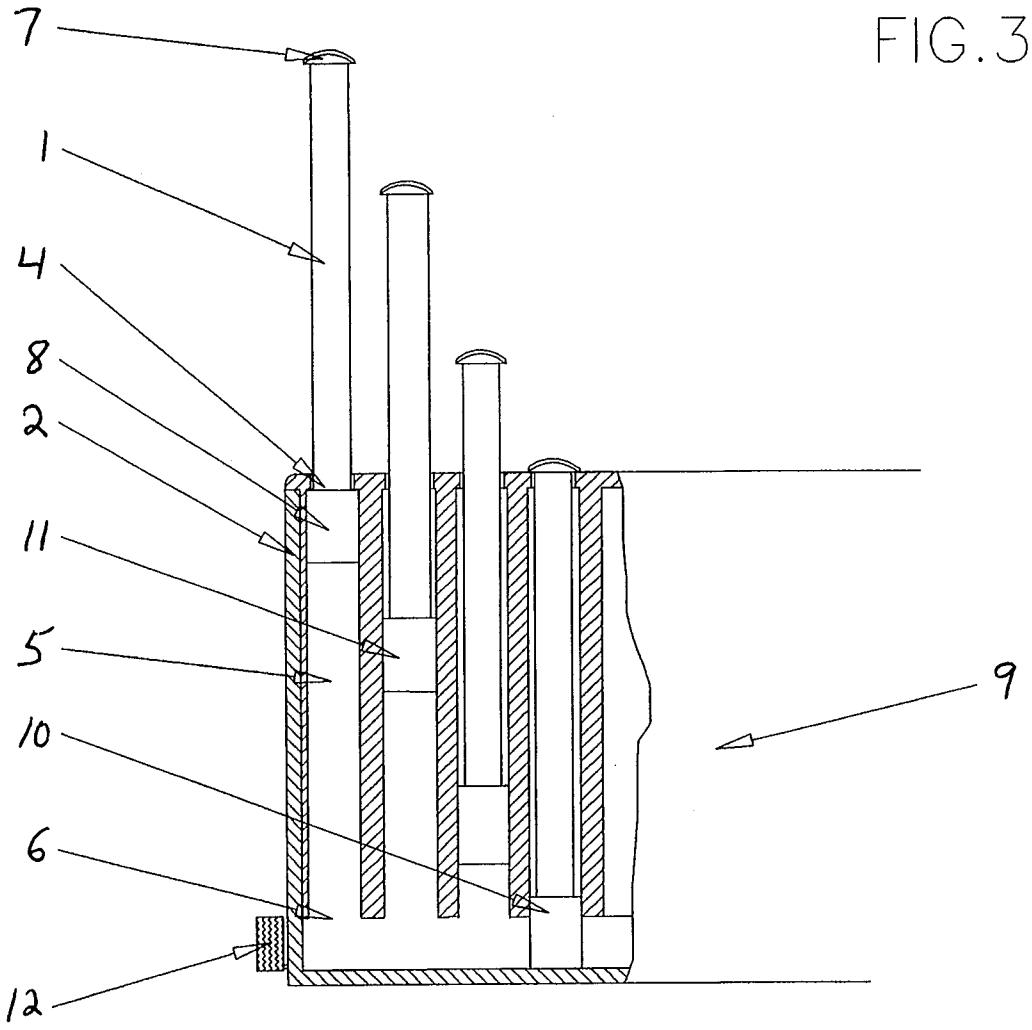
FIG. 3 is a detailed view of the bed illustrated in FIG. 2.

FIG. 3 illustrates that dowels 1 have a soft dome 7 and an enlarged lower section 8. The lower section 8 of dowels 1 are enclosed within guide chambers 5. Each of guide chambers 5 have a top 9, a bottom 10, and a between region 11. Guide chambers 5 are perfectly sized to allow only vertical movement of the lower section 8 of dowels 1 from top 9 to bottom 10, or anywhere between 11. All guide chambers 5 are found within the modular multi-chambered base 2 and each of the guide chambers 5 has a gasket sealing system 4 which prevents fluid or gas from leaving guide chambers 5. Guide chambers 5 open into common fluid chamber 6 which allows interdependent flow of the fluid or gas between all guide chambers 5. Common chamber 6 is also equipped a coupler 12 which enables a displacement tank 13 to be connected to common fluid chamber 6.

Figure 4:
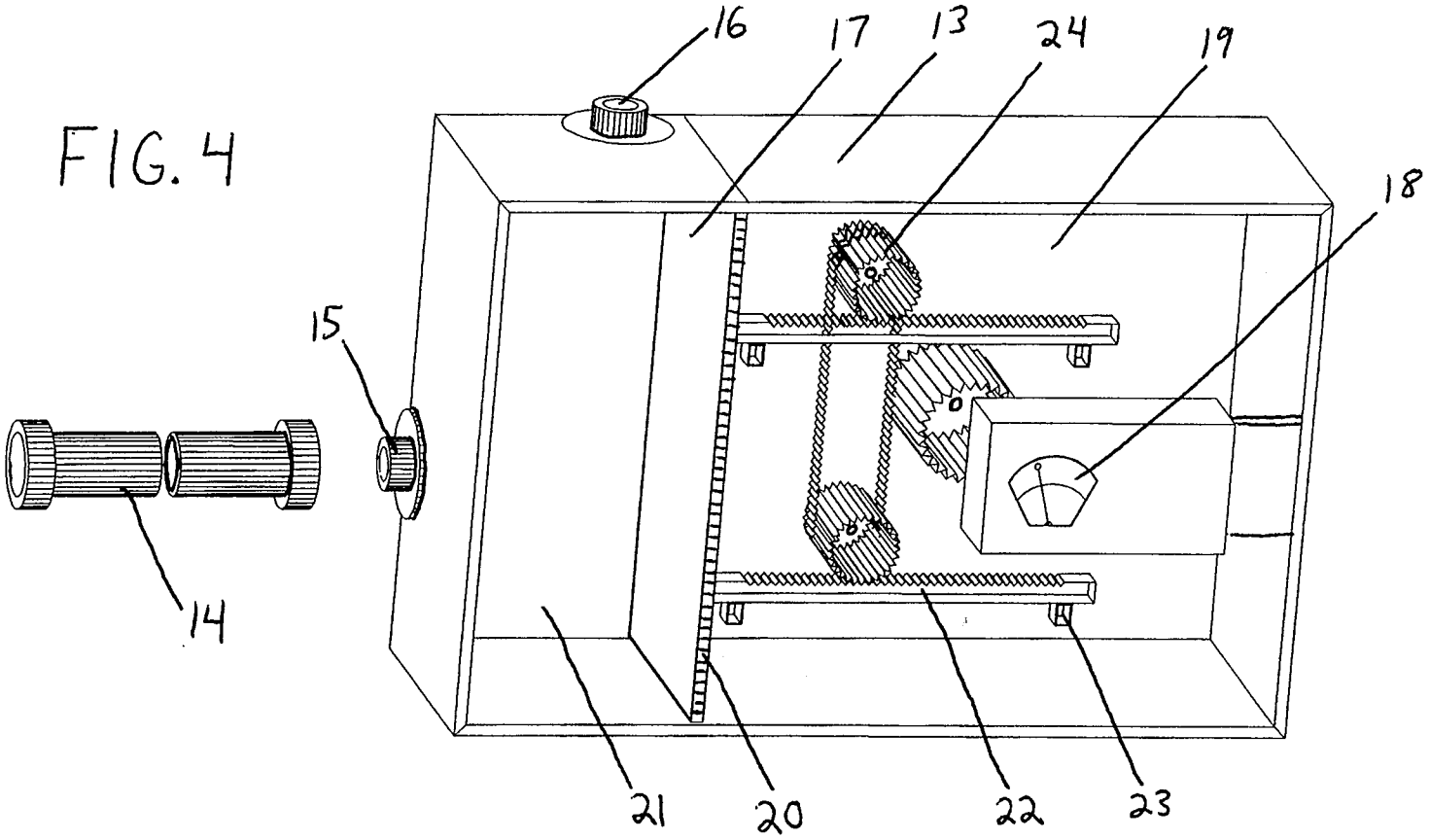
FIG. 4 is a cut away perspective view of a displacement tank.
Figure 5:
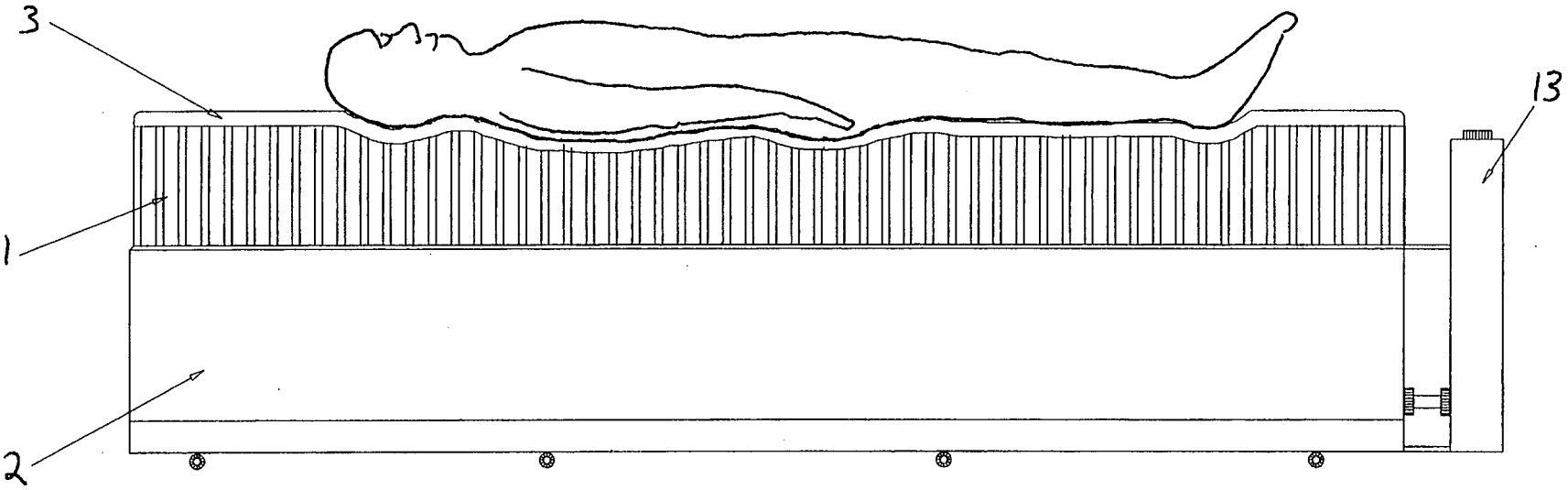
FIG. 5 is a side elevation view of the bed illustrated in FIG. 1 with the displacement tank illustrated in FIG. 4.

FIG. 4 shows displacement tank 13. A hose 14 is used to connect coupler 12 from common fluid chamber 6 with a coupling 15 on displacement tank 13. Displacement tank 13 has a filler cap 16 which allows filling common fluid chamber 6 with the appropriate fluid or gas. Displacement tank 13 has a pressure counterbalance in the form of a pressure member 17 with a mechanism for producing a counterpressure as will hereinafter be described. The counterpressure is provided by weigh scale 18 with an adjustable tension spring mechanism. When the bed is full of fluid or gas pressure member 17 and weigh scale 18 would both remain at a "zero" or non-displaced position. When a person's body lies on the bed exerting a downward pressure upon some of dowels 1, fluid is displaced into displacement tank 13. The entry of displaced fluids into displacement tank 13 exerts pressure upon pressure member 17 to push pressure member 17 into a counterbalance portion 19 of displacement tank 13. Fluid is prevented from passing pressure member 17 into counterbalance portion 19 of displacement tank 13 by a seal gasket 20. Pressure from displaced fluid 21 causes pressure member 17 to move into counterbalance portion 19 of displacement tank 13. The movement of pressure member 17 into counterbalance portion 19 is resisted by the mechanism for creating a counterpressure. This mechanism consists of grooved rails 22 which slide within guides 23 and rotate wheels 24 which apply a counterpressure provided by weigh scale 18 with an adjustable tension spring mechanism.

The use and operation of the bed will now be described with reference to FIGS. 1 through 5. When a body lies on the bed a downward pressure is exerted upon some of dowels 1 which displaces fluid in guide chambers 5. The displaced fluid will flow via common fluid chamber 6 to displacement tank 13. Displaced fluid 21 in displacement tank 13 will exert a pressure via pressure member 17 upon the counterbalance and tension spring mechanism within weigh scale 18. Counterbalance weigh scale 18 will counterbalance the weight of the body back through common fluid chamber 6 to each guide chamber 5. The counter-pressure will be divided equally among all activated dowels.

Figure 6:
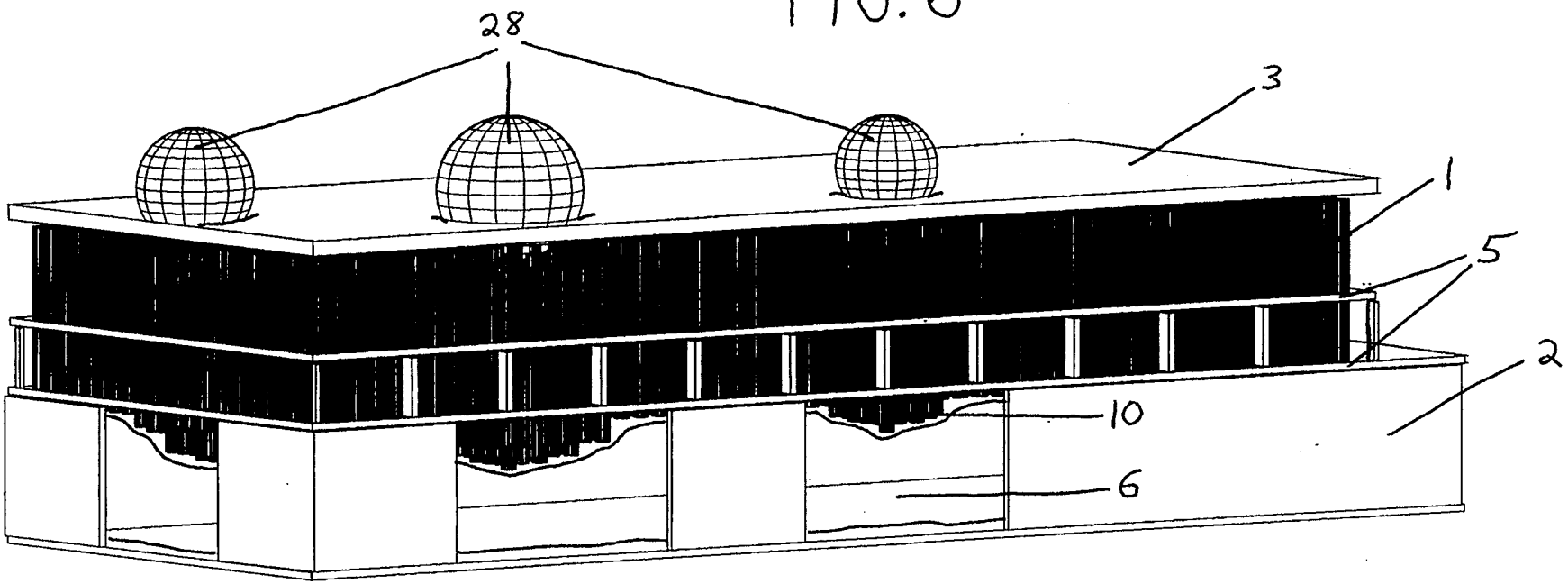
FIG. 6 is a partially cut away side elevation view of a second embodiment of a bed constructed in accordance with the teachings of the present invention.
Figure 7:
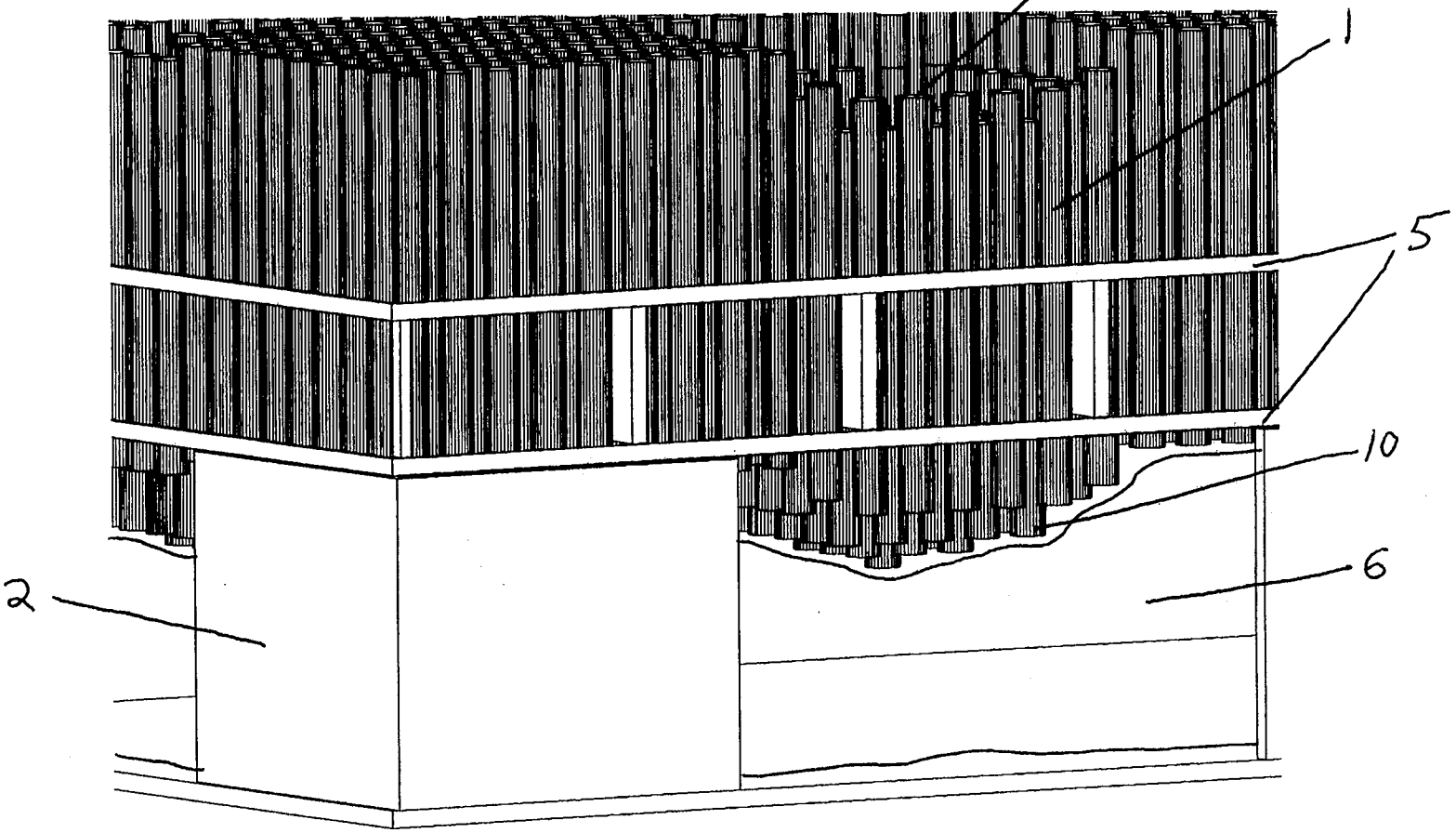
FIG. 7 is a detailed view of the bed illustrated in FIG. 6.
Figure 8:
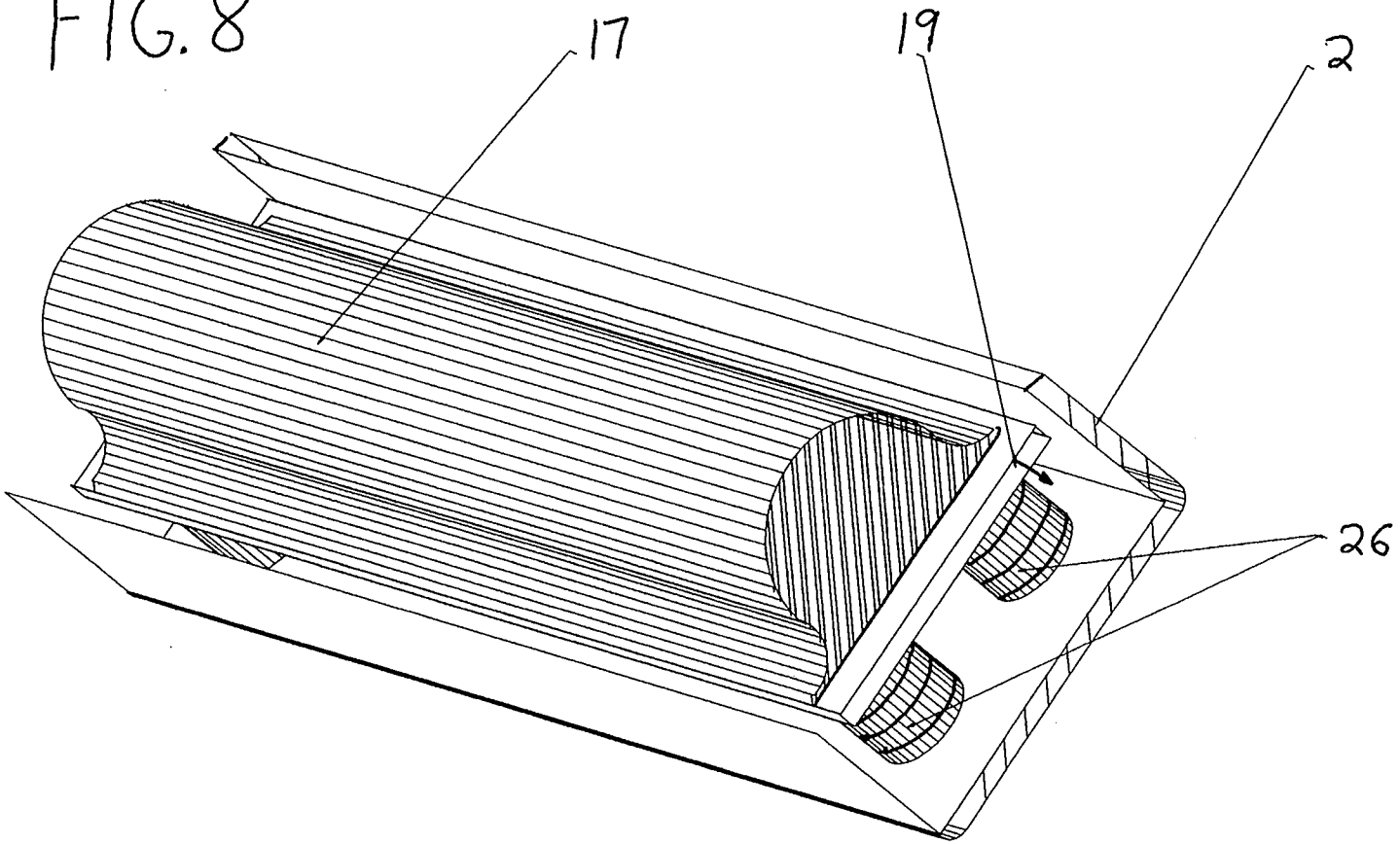
FIG. 8 is a detailed view of a counterbalance member from the bed illustrated in FIG. 6.
Figure 10:
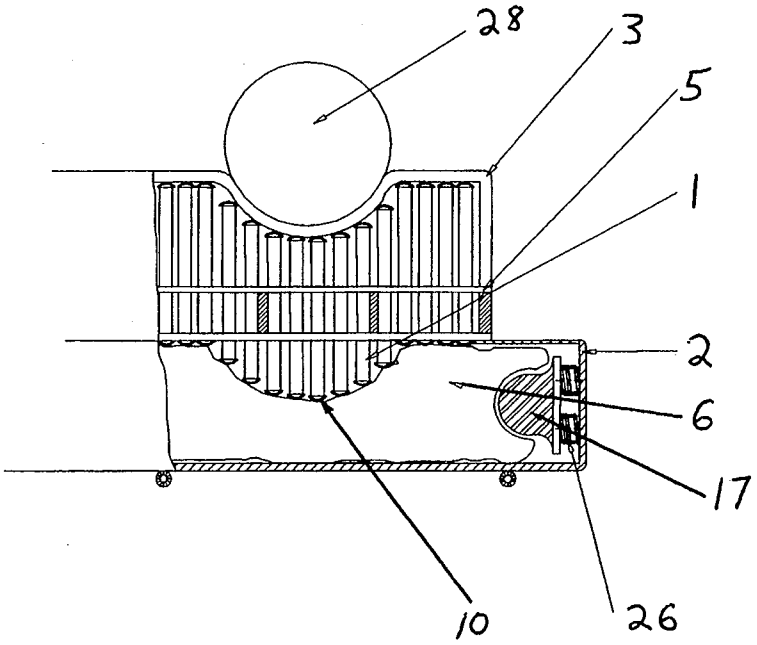
FIG. 10 is a side elevation view in longitudinal section of the bed illustrated in FIG. 6 with the counterbalance member in a second position.
Figure 9:
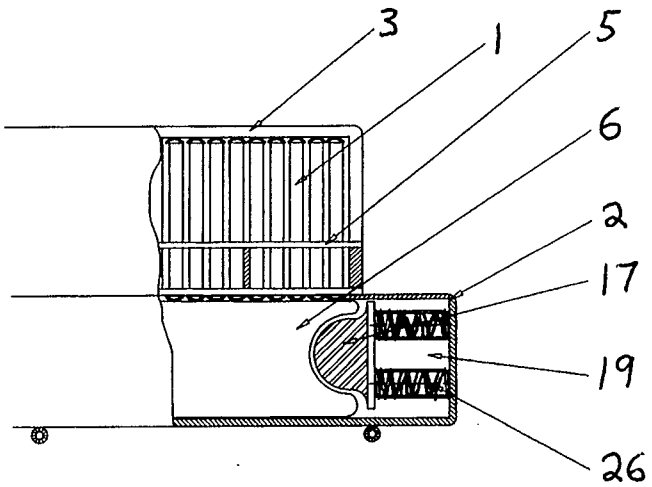
FIG. 9 is a side elevation view in longitudinal section of the bed illustrated in FIG. 6 with the counterbalance member in a first position.

FIGS. 6 through 10 illustrate a second embodiment of the bed. Referring to FIGS. 6 and 7, in this embodiment fluid chamber 6 is in the form of a deformable bladder which greatly simplifies the sealing of fluid chamber 6 to prevent the leakage of fluid. Referring to FIGS. 9 and 10, pressure member 17 is positioned within base 2 and acts directly upon deformable bladder 6. Referring to FIG. 8, pressure member 17 has a padded protruding contact member to effectively exert pressure without piercing deformable bladder 6. A counterpressure is transferred to pressure member 17 by springs 26.

The use and operation of the second embodiment will now be described with reference to FIGS. 6 through 10. When a body 28 is positioned on the bed, body support members 1 move vertically in relation to guides 5 to exert a pressure upon deformable bladder 6. The fluid in deformable bladder 6 exerts pressure upon pressure member 17 which is counterbalanced by pressure exerted by springs 26.

It will be apparent to one skilled in the art that by utilizing displacement tank 13 with a pressure counterbalance that includes pressure member 17 and a counterbalance mechanism, the problem of ballooning can be effectively solved. It will also be apparent to one skilled in the art that there are alternative forms of pressure counterbalance that would be serve the intended purpose equally well, as is illustrated in FIGS. 6 through 10. It will finally be apparent to one skilled in the art that there are other changes that may be made to the illustrated embodiments without departing from the spirit and scope of the invention as defined by the claims.

The embodiments of the invention in which a exclusive property or privilege is claimed are defined as follows:

1. A bed, comprising:

a. a plurality of body support members;

b. a plurality of closely spaced vertically aligned body support guides, one of the body support members being telescopically received in each of the guides such that the body support members protrude vertically from the guides;

c. a fluid chamber underlying the plurality of guides, such that a downward pressure applied to one body support member is transmitted via fluid in the fluid chamber to all body support members, the body support members being telescopically movable relative to the guides in response to fluid pressure;

d. sealing means to prevent leakage of fluid from the fluid chamber;

e. stop means to limit the telescopic movement of the body support members; and f. a displaceable pressure counterbalance whereby an adjustable counter-pressure is exerted upon fluid in the fluid chamber to match the pressure exerted upon fluid in the fluid chamber by a body at rest upon the body support members.

2. The bed as defined in claim 1, the fluid chamber being in the form of a deformable bladder, the bladder preventing the leakage of fluid from the fluid chamber.

3. The bed as defined in claim 1, the fluid chamber being in fluid communication with a displacement tank adapted to receive fluid displaced when a downward pressure is exerted upon the body support members, the pressure counterbalance being disposed in the displacement tank whereby an adjustable, equalized counterpressure is exerted upon fluid in the fluid chamber.

4. The bed as defined in claim 1, the pressure counterbalance exerting an adjustable pressure upon the deformable bladder, thereby exerting an equalized counterpressure upon fluid in the fluid chamber.

5. The bed as defined in claim 1, seals being disposed between the body support members and the body support guides, thereby preventing the leakage of fluid from the fluid chamber.

6. The bed as defined in claim 1, the stop means including an enlarged lower section on the body support members which engages a smaller radius portion in the body support guides.

7. A bed, comprising:

a. a plurality of body support members;

b. a plurality of closely spaced vertically aligned body support guides, one of the body support members being telescopically received in each of the guides such that the body support members protrude vertically from the guides;

c. a fluid chamber in the form of a deformable bladder underlying the plurality of guides, such that a downward pressure applied to one body support member is transmitted via fluid in the fluid chamber to all body support members, the body support members being telescopically movable relative to the guides in response to fluid pressure, the bladder serving as sealing means to prevent leakage of fluid from the fluid chamber;

d. an enlarged lower section on the body support members which engages a smaller radius portion in the body support guides, thereby limiting the telescopic movement of the body support members; and e. a displaceable pressure counterbalance exerting an adjustable counter-pressure upon the deformable bladder, thereby exerting an adjustable counterpressure upon the fluid in the fluid chamber to match the pressure exerted upon the deformable bladder by a body at rest upon the body support members.

8. A bed, comprising:

a. a plurality of body support members;

b. a plurality of closely spaced vertically aligned body support guides, one of the body support members being telescopically received in each of the guides such that the body support members protrude vertically from the guides;

c. a fluid chamber underlying the plurality of guides, such that a downward pressure applied to one body support member is transmitted via fluid in the fluid chamber to all body support members, the body support members being telescopically movable relative to the guides in response to fluid pressure;

d. seals being disposed between the body support members and the body support guides, thereby preventing the leakage of fluid from the fluid chamber;

e. an enlarged lower section on the body support members engaging a smaller radius portion in the body support guides, thereby limiting the telescopic movement of the body support members; and f. a displacement tank in fluid communication with the fluid chamber, the displacement tank being adapted to receive fluid displaced from the fluid chamber when a downward pressure is exerted upon the body support members, a displaceable pressure counterbalance being disposed in the displacement tank whereby an adjustable counterpressure is exerted upon fluid in the fluid chamber to match the pressure exerted upon fluid in the fluid chamber by a body at rest upon the body support members.

* * * * *